US006089210A

United States Patent [19]

Kadowaki

[11] Patent Number: 6,089,210

[45] Date of Patent: Jul. 18, 2000

[54] APPARATUS FOR CONTROLLING AIR-FUEL RATIO OF INTERNAL COMBUSTION ENGINE

[75] Inventor: Hisashi Kadowaki, Kariya, Japan

[73] Assignee: Denso Corporation, Kariya, Japan

[21] Appl. No.: 08/917,908

[22] Filed: Aug. 27, 1997

[30] Foreign Application Priority Data

Aug. 27, 1996 [JP] Japan ..... 8-225130

[51] Int. Cl.[7] ..... F02M 33/02

[52] U.S. Cl. ..... 123/520; 123/198 D

[58] Field of Search ..... 123/520, 519, 123/518, 521, 516, 198 D

[56] References Cited

U.S. PATENT DOCUMENTS

| | | | |
|---|---|---|---|
| 4,867,126 | 9/1989 | Yonekawa et al. . | |
| 4,986,070 | 1/1991 | Abe | 123/520 |
| 5,150,686 | 9/1992 | Okawa | 123/520 |
| 5,426,938 | 6/1995 | Ogawa | 123/520 |
| 5,619,973 | 4/1997 | Hara | 123/520 |
| 5,634,451 | 6/1997 | Tomisawa | 123/520 |
| 5,676,118 | 10/1997 | Saito | 123/520 |
| 5,699,778 | 12/1997 | Muraguchi | 123/520 |
| 5,706,789 | 1/1998 | Yamada | 123/520 |

FOREIGN PATENT DOCUMENTS

B2 7-3211 of 0000 Japan .

*Primary Examiner*—Carl S. Miller
*Attorney, Agent, or Firm*—Nixon & Vanderhye P.C.

[57] ABSTRACT

To control the air-fuel ratio of an internal combustion engine without variations and thus suppress deterioration of the exhaust gas, a canister for adsorbing evaporated fuel is connected to a fuel tank. A release passage connects the canister to an intake tube for an internal combustion engine. A purge duty cycle flow rate control valve is installed in this release passage. An ECU provides feedback control of the air-fuel ratio according to the oxygen concentration in exhaust gas, controls the idle speed via an ISC valve, and controls purge by the purge duty cycle vacuum switching valve. As the purge is carried out, evaporated gas is released from the canister and purged. The ECU makes a decision, in a non-purging mode, as to whether the amount of the purged gas reaches a purge limit that is a critical value tolerated at each instant of time. If the result is that the purge limit will be reached, the execution of the purge is inhibited. At this time, the purge limit is established according to a range of purged flow rates that might hinder the operation of the internal combustion engine.

22 Claims, 9 Drawing Sheets t1
t2
t3
t4
t5
(LG)
PURGE RATE PGR
0

(LG)
PURGE DUTY RATIO
r
0

XPRG
1
0

EXEC.
PURGE
NO EXEC.

PURGE LIM. EST. FLAG
1
0
TIME

APPARATUS FOR CONTROLLING AIR-FUEL RATIO OF INTERNAL COMBUSTION ENGINE

CROSS-REFERENCE TO RELATED APPLICATION

This application is related to Japanese Patent Application No. Hei 8-225130, incorporated herein by reference.

BACKGROUND OF THE INVENTION

1. Field of the Invention

The present invention relates to an air-fuel ratio-controlling apparatus for use with an internal combustion engine equipped with a canister for temporarily storing fuel vapor generated in the fuel tank, the apparatus acting to release the fuel vapor stored in the canister into the intake system of the engine along with air.

2. Description of Related Art

A prior art automotive internal combustion engine is typically equipped with a canister for temporarily storing fuel vapor generated inside the fuel tank. The canister is connected to the intake side of the internal combustion engine via a release passage. A flow control valve consisting, for example, of a solenoid valve is disposed in the release passage. Fuel vapor stored in the canister is released into the internal combustion engine along with air into the release passage according to the opening of the flow control valve.

The technique of this kind is known, for example, in Japanese Examined Patent Publication No. Hei 7-3211. In this technique, the concentration of the remaining oxygen in the exhaust gas is detected. The amount of feedback for correcting the air-fuel ratio is calculated from the result of the detection. When the amount of deviation of the feedback correction amount caused by the fuel vapor released into the internal combustion engine exceeds a given amount, the amount of purged fuel vapor and air (evaporated gas) from the canister is reduced. Therefore, if a rich evaporated gas is introduced, the air-fuel ratio can be controlled to a desired value.

The prior art technique described above produces the following problems. In a high-temperature environment or where a highly volatile fuel is held in the fuel tank, it is assumed that a rich evaporated gas is introduced into the canister. When the apparatus is just switched from a non-purging mode to a purging mode, a large amount of fuel contained in the evaporated gas is introduced into the internal combustion engine. That is, the purged fuel becomes excessive. After this transient time, there arises the possibility of reducing the purged flow rate. In this case, if the purged flow rate is controlled to a desired amount during the transient time between the non-purging mode and the purging mode, the purged flow rate is reduced down to 0 because of the stop of the purge. Then, the purged flow rate is again controlled to a desired amount. In particular, the state changes as given by Equation (1):

$$\text{purged flow rate}>0 \rightarrow \text{purged flow rate}=0 \rightarrow \text{purged flow rate}>0 \ldots \quad (1)$$

Thus, the purge is intermittently and repeatedly carried out. As a result, the air-fuel ratio is varied and disturbed greatly, thus presenting various problems such as deterioration of the quality of the exhaust gas.

SUMMARY OF THE INVENTION

In view of the foregoing problems, the present invention has been made. It is an object of the invention to provide an apparatus for controlling the air-fuel ratio of an internal combustion engine, the apparatus being capable of regulating the air-fuel ratio, thus suppressing deterioration of the quality of the exhaust gas.

The above object is achieved according to an aspect of the invention by providing a system in which a canister for adsorbing evaporated fuel is connected to a fuel tank, and a release passage connects the canister to an intake tube for an internal combustion engine. A purge duty cycle flow rate control valve is installed in the release passage. An ECU provides feedback control of the air-fuel ratio according to the oxygen concentration in exhaust gas, controls the idle speed via an ISC valve, and controls purge by the purge duty cycle vacuum switching valve. As the purge is carried out, evaporated gas is released from the canister and purged. The ECU makes a decision, in a non-purging mode, as to whether the amount of the purged gas reaches a purge limit that is a critical value tolerated at each instant of time. If the result is that the purge limit will be reached, the execution of the purge is inhibited. At this time, the purge limit is established according to a range of purged flow rates that might hinder the operation of the internal combustion engine.

In this way, during non-purging mode, a decision is made as to whether the amount of purged evaporated gas released by the intake system of the engine by the canister reaches the purge limit (instantaneous limit value). If arrival at the purge limit is forecast, the execution of the purge is inhibited. This structure circumvents the problem with the prior art apparatus, i.e., purge is intermittently carried out after the transition from non-purging to purging mode. Consequently, the air-fuel ratio is regulated. Thus, deterioration of the quality of the exhaust gas can be suppressed.

Preferably, the purge limit is forecast only in the non-purging mode. A decision is made according to the result as to whether the purge should be carried out. Therefore, the purge is not excessively interrupted, e.g., the purge is not forcedly interrupted during the execution of purge. Hence, problems such as a deterioration of the quality of the purge coefficient are not induced.

Also preferably, a range of amount of purged evaporated gas hindering the operation of internal combustion engine is forecast as the purge limit. In this range of amount hindering the operation of the engine, the purge is intermittently and repeatedly carried out and consequently disturbs the air-fuel ratio. When the purge limit is established in this way, the purge limit can be preferably and easily forecast. This assures the start of purge in the above-described purge limit regions.

Other objects and features of the present invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

Figure 1:
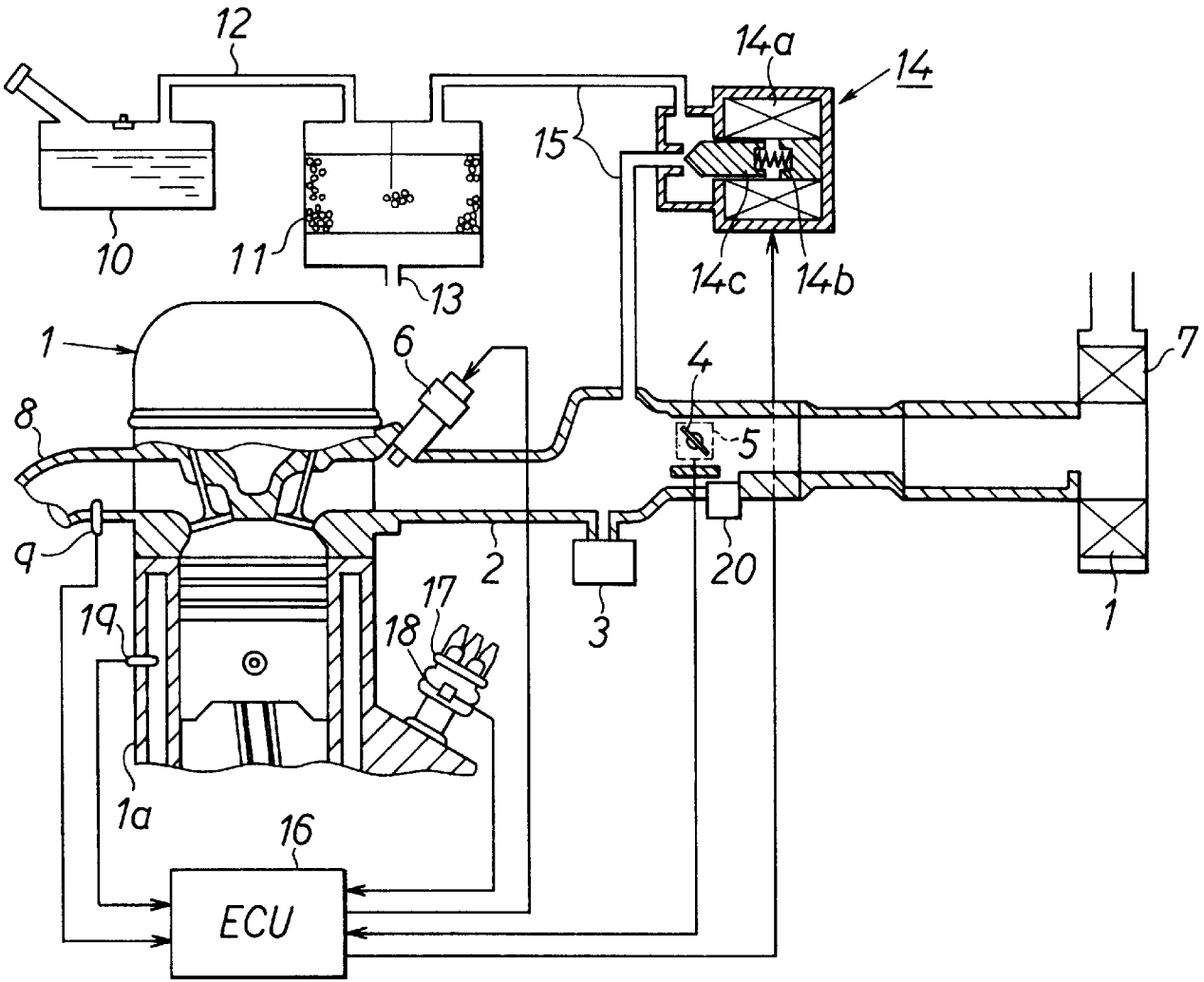
FIG. 1 is a schematic of an air-fuel ratio controller according to a preferred embodiment of the present invention.

A preferred embodiment of the present invention is hereinafter described by referring to the drawings.

An air-fuel ratio-controlling apparatus according to the present embodiment is built around an electronic control unit (hereinafter referred to as the ECU) consisting of a microprocessor or the like, as is known in the art. This apparatus provides feedback control of the air-fuel ratio according to the concentration of the oxygen remaining in the exhaust gas. In addition, the apparatus has a function of adjusting the amount of auxiliary air into the internal combustion engine at idle, i.e., it performs idle speed control (ISC). Also, the apparatus has a function of releasing fuel evaporated inside the fuel tank into the engine intake system, i.e., it performs a purge control function. The structure and action of this air-fuel ratio-controlling apparatus are hereinafter described successively.

In FIG. 1, an internal combustion engine 1 is a multiple-cylinder, gasoline-injected internal combustion engine having multiple cylinders. An intake pipe 2 is connected to this engine and equipped with a surge tank 2*a*. An intake pressure sensor 3 for detecting the pressure PM of introduced air, that is, the pressure inside the intake tube 2, is disposed inside the tank 2*a*. A throttle valve 4 interlocking with the accelerator pedal (not shown) when the driver pushes down on the pedal is disposed upstream of the surge tank 2*a*. The opening (throttle opening TA) of the throttle valve 4 is detected by a throttle sensor 5. An electromagnetically operated injector 6 is mounted on the most downstream side of the intake tube 2. An air filter 7 is disposed on the most upstream side of the intake tube 2. The injector 6 is driven according to the output signal from the ECU 16 and adjusts the amount of fuel supplied to the internal combustion engine 1.

An ISC valve 20 is installed in the intake valve 2 to adjust the amount of air bypassing the throttle valve 5. This ISC valve 20 is opened and closed according to an instruction signal from the ECU 16. The amount of air that the ISC valve 20 passes (ISC flow rate) is adjusted so that the engine speed at idle reaches a desired target value, e.g., approximately 70 rpm.

An exhaust pipe 8 connected to the internal combustion engine 1 is equipped with an oxygen ($O_2$) sensor 9 that produces a voltage signal indicating a rich/lean state according to the concentration of oxygen in the exhaust gas.

A fuel tank 10 holding fuel (gasoline) supplied to the internal combustion engine 1 is connected to a canister 11 via a tank port passage 12. Charcoal acting as an adsorbent for adsorbing fuel evaporated inside the fuel tank 10 is held in the canister 11. This canister 11 is provided with an air port passage 13 for introducing outside air. The canister 11 and the downstream side (surge tank 2*a*) of the throttle valve 4 in the intake tube 2 are connected together by a release passage 15. The evaporated gas supplied from the canister 11 is released to the assembly portion (an upstream portion which is not shown of the intake manifold) of the intake tube 2.

A purge duty cycle vacuum switching valve (VSV) 14 acting as a flow control valve for controlling the purged flow rate is mounted in the release passage 15. This switching valve 14 has a valve body 14*c* consisting of a movable iron member that is kept closed by a spring 14*b*. The valve body 14*c* is moved into its open position against the biasing force of the spring 14*b* by energizing a coil 14*a*. That is, during the energization of the coil, the valve body 14*c* is attracted to the coil 14*a*, thus opening the release passage 15 that is under a negative pressure.

In this case, the ECU 16 supplies a control signal to the purge duty cycle vacuum switching valve 14 to place the canister 11 in communication with the intake tube 2 via the release passage 15. Thus, fresh air is introduced from the atmosphere via the air port passage 13. Consequently, fresh air ventilates the inside of the canister 11 and is sent into the intake pipe 2 of the internal combustion engine 1. As a result, the absorbing function of the canister 11 is regained. At this time, the purged flow rate Qp (liters/min) according to the amount of fresh air is adjusted by varying the duty cycle (also known as the duty factor) of a pulse signal supplied to the purge duty cycle vacuum switching valve 14. That is, the opening of the switching valve 14 is adjusted according to a duty cycle signal based on pulse-width modulation, the duty cycle signal coming from the ECU 16. In this way, the purged flow rate Qp of the air containing the fuel evaporated from the canister 11 is adjusted.

The ECU 16 includes an input signal-processing circuit, an arithmetic circuit, an output signal circuit (driver circuit), a power circuit, etc. These circuits successively receive output signals from the intake pressure sensor 3, throttle sensor 5, and oxygen sensor 9. Other sensors for detecting the operating condition of the internal combustion engine 1 are also provided. That is, an engine speed sensor 18 for detecting the engine speed NE of the internal combustion engine 1 is mounted on a distributor 17. A water temperature sensor 19 for detecting the temperature THW of coolant circulated through the cylinder is mounted in a cylinder block la. Output signals from the sensors 18 and 19 are also applied to the ECU 16. If necessary, an intake air temperature sensor for detecting the temperature of air drawn in through the air filter 7 may be provided. The output signal from this sensor may be applied to the ECU 16.

The ECU 16 judges whether the air-fuel mixture is rich or lean according to the voltage signal from the oxygen sensor 9 and determines a feedback correction coefficient FAF. The ECU provides feedback control of the air-fuel ratio using this FAF value. Furthermore, the ECU 16 determines the fundamental injection time TP from the operating condition of the engine. In addition, the ECU corrects the fundamental injection time TP according to the FAF value and so on, finds the final injection time TAU, and causes the injector 6 to inject fuel at given injection timing using this TAU value.

The operation of the air-fuel ratio-controlling apparatus according to the present embodiment is next described, the apparatus being for use with an internal combustion engine. In the present embodiment, multiple programs used for calculations loaded in the ECU 16 are executed to perform following various operations, i.e., feedback control of the air-fuel ratio, calculation of the concentration of the evaporated gas, control of the injection of the fuel, control of the idle speed, and control of the duty cycle vacuum switching valve (VSV). The individual programs for calculations are next described one after another.

[Feedback Control of Air-Fuel Ratio]

Figure 2:
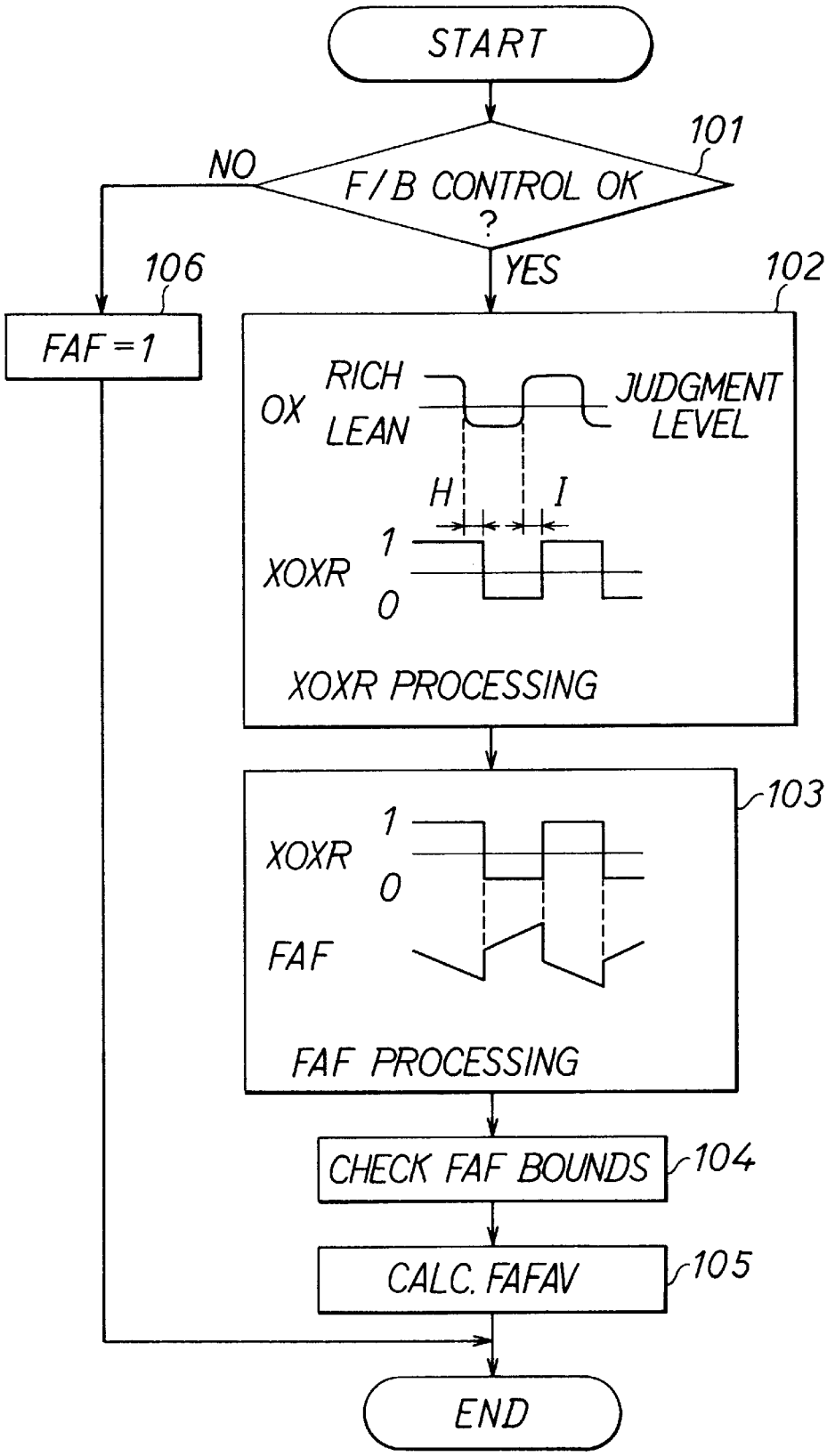
FIG. 2 is a flowchart illustrating an air-fuel ratio feedback control routine according to the embodiment.

A routine for providing feedback control of the air-fuel ratio is described by referring to the flowchart of FIG. 2. This routine for controlling the air-fuel ratio is carried out at intervals of about 4 ms by the ECU 16.

After starting the routine illustrated in FIG. 2, the ECU 16 first judges whether the feedback (F/B) control condition is valid or not (Step 101). This condition holds primarily when the following requirements are all satisfied.

(1) The vehicle is not at start-up.

(2) The fuel is not being cut.

(3) The temperature THW of the coolant is higher than a given temperature.

(4) The oxygen sensor 9 is in operation.

(5) The load is not high. Also, the engine speed is not high.

If the feedback (F/B) control condition holds, the ECU 16 proceeds to Step 102. The ECU 16 compares the voltage signal from the oxygen sensor 9 with a given decision level (Step 102), and operates an air-fuel ratio flag XOXR with delay times H and I, respectively. At this time, if the voltage signal from the oxygen sensor 9 indicates that the air-fuel ratio is rich, the air-fuel ratio flag XOXR is set to 1. If the voltage signal indicates that the air-fuel ratio is lean, the air-fuel ratio flag XOXR is cleared, i.e., set to 0.

Then, the ECU 16 goes to Step 103, where the FAF value is operated according to the air-fuel ratio flag XOXR. In particular, when the air-fuel ratio flag XOXR has changed from 0 to 1 or from 1 to 0, the FAF value is varied by a given increment. When the air-fuel ratio flag XOXR is kept at 1 or 0, the FAF value is controlled by integration, i.e., increased or reduced gradually. Then, the ECU 16 checks the upper and lower limits of the FAF value (Step 104) and proceeds to Step 105. The ECU performs smoothing processing in every increment or at every given time interval according to the FAF value determined described above to calculate the average value of FAF values, or FAFAV value. As an example, the FAFAF value is calculated according to the following Equation (2):

$$FAFAV=\{FAFAV_{i-l}\cdot n+FAF\cdot(256-n)\}/256 \quad (2)$$

where the subscript $_{i-l}$ indicates that it is a previous value of the average value FAFAV. n is a constant determining the degree to which values are smoothed.

If the feedback (F/B) control condition does not hold at Step 101, the ECU 16 proceeds to Step 106, where the FAF value is set to 1.0. The ECU 16 once stops the present routine. The FAF value is an index indicating the deviation from the theoretical air-fuel ratio (14.7).

[Calculation of Concentration of Evaporated Gas]

Figure 3:
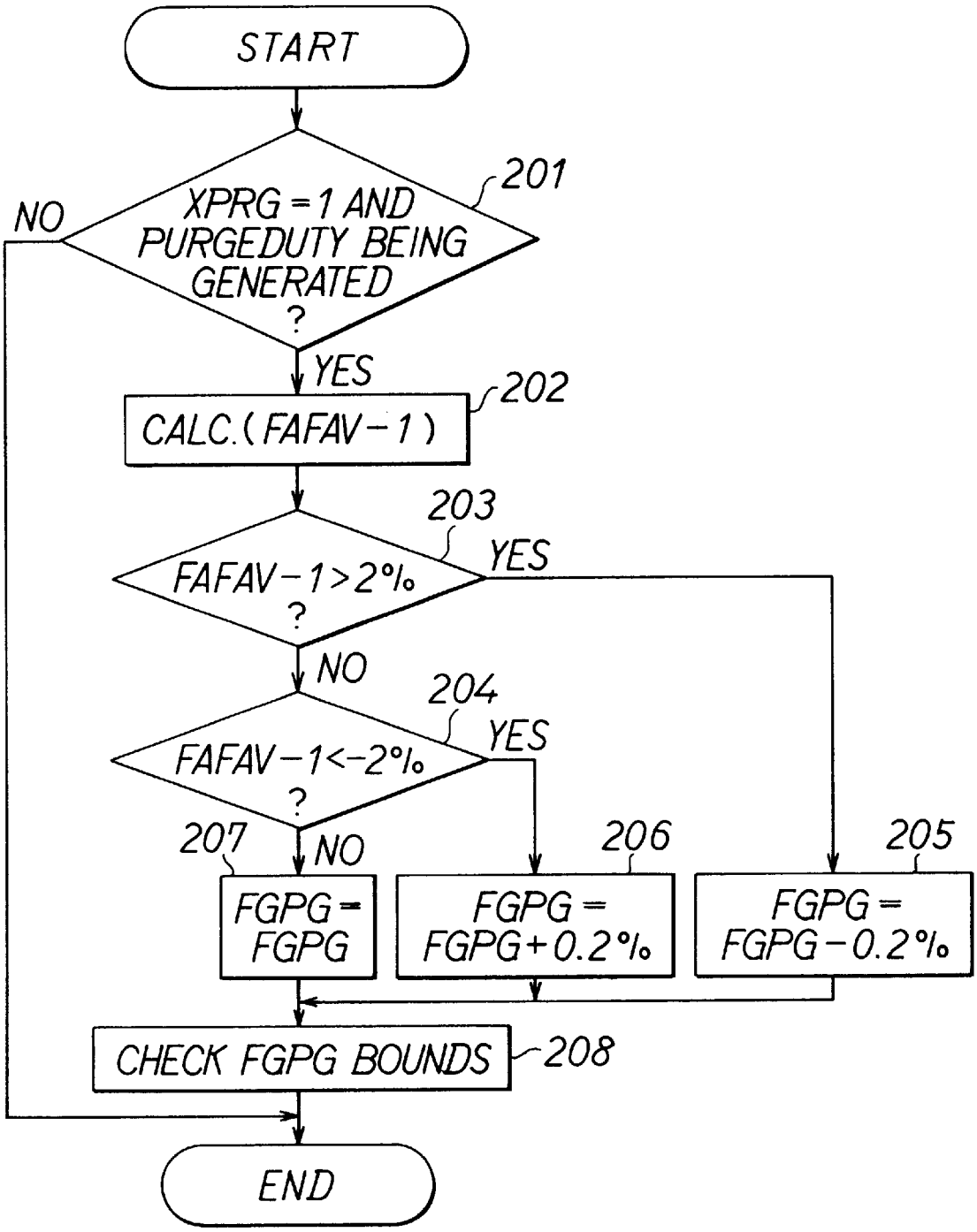
FIG. 3 is a flowchart illustrating a routine for calculating the concentration of evaporated gas according to the embodiment.

An evaporated gas concentration calculation routine for calculating the concentration of the evaporated gas is next described by referring to the flowchart of FIG. 3. This routine is carried out at intervals of about 16 ms by the ECU 16.

When the present routine begins, the ECU 16 makes a decision as to whether a purge execution-permitting flag XPRG is equal to 1 and whether the purge duty cycle vacuum switching valve 14 is delivering an output signal (Step 201). This purge execution-permitting flag XPRG is a flag indicating whether the execution of purge is allowed or not. XPRG=1 indicates that the execution of purge is allowed. XPRG=0 indicates that the execution of purge is not allowed. That the purge duty cycle vacuum switching valve 14 is delivering an output signal means that the switching valve 14 is activated and that the evaporated gas is actually being purged.

If the result of the decision made at Step 201 is NO, i.e., the purge is not executed, the ECU 16 immediately ends the routine. If the result of the decision made at Step 201 is YES, i.e., the purge is being executed, the ECU 16 calculates the difference between the FAFAV value that is the averaged value of the FAF values and a reference value (=1) of the FAF value, i.e., FAFAV−1, (Step 202). Then, the concentration FGPG of the evaporated gas is calculated from the FAFAV−1 at Steps 203–207.

More particularly, the ECU 16 makes a decision at Step 203 as to whether the relation FAFAV−1>2% holds, i.e., whether the air-fuel ratio is lean. Also, the ECU 16 makes a decision at Step 204 as to whether relation FAFAV−1<−2% holds, i.e., whether the air-fuel ratio is rich. If the relation FAFAV−1>2% holds, i.e., the air-fuel ratio is lean, the ECU 16 judges that the actual value of the FGPG is leaner than the present FGPG value. The ECU reduces the FGPG value by a given amount (0.2% in the present embodiment) (Step 205). If the relationship FAFAV−1<−2% holds, i.e., the air-fuel ratio is rich, the ECU 16 judges that the actual value of the FGPG is richer than the present FGPG value, and increases the FGPG value by a given amount (0.2% in the present embodiment) (Step 206). If the relationship −2%≦FAFAV−1≦2% holds, the ECU 16 judges that the present FGPG value substantially agrees with the actual value, and holds the present FGPG value (Step 207).

After the calculation of the PGPG value, the ECU 16 checks to see if the FGPG value is within 0 to 25%, i.e., within the upper and limits (Step 208). Then, the ECU ends the present routine.

[Control of Fuel Injection]

Figure 4:
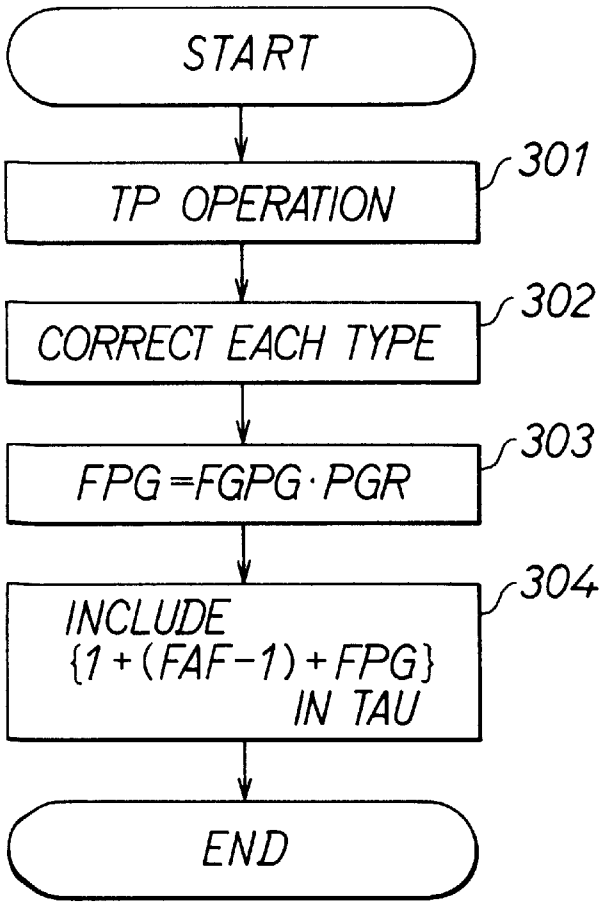
FIG. 4 is a flowchart illustrating a routine for controlling the fuel injection according to the embodiment.

A routine for controlling the injection of the fuel is described by referring to the flowchart of FIG. 4. This routine is also carried out at intervals of approximately 4 ms by the ECU 16. The present routine controls the operation of the injector 6.

In FIG. 4, the ECU 16 first calculates the fundamental injection time TP of the injector 6 from the engine speed NE and from the engine load (e.g., intake air pressure PM) (Step 301). The ECU then performs various fundamental corrections (corrections made depending on the temperature of the coolant and on the temperature of the intake air after start-up) (Step 302). Thereafter, the ECU 16 proceeds to Step 303 to multiply the concentration FGPG of the evaporated gas calculated by the routine illustrated in FIG. 3 by a purge coefficient PGR calculated by a routine described later in connection with FIGS. 6 and 7, thus computing a purge correction coefficient FPG (FPG=PGPG·PGR)

Finally, at Step 304, the ECU 16 substitutes the FAF value and the FPG value into the following Equation (3):

$$1+(FAF-1)+FPG \quad (3)$$

This is calculated as a correction coefficient, which is reflected in the final injection time TAU of the injector 6.

[Control of Idle Speed]

Figure 5:
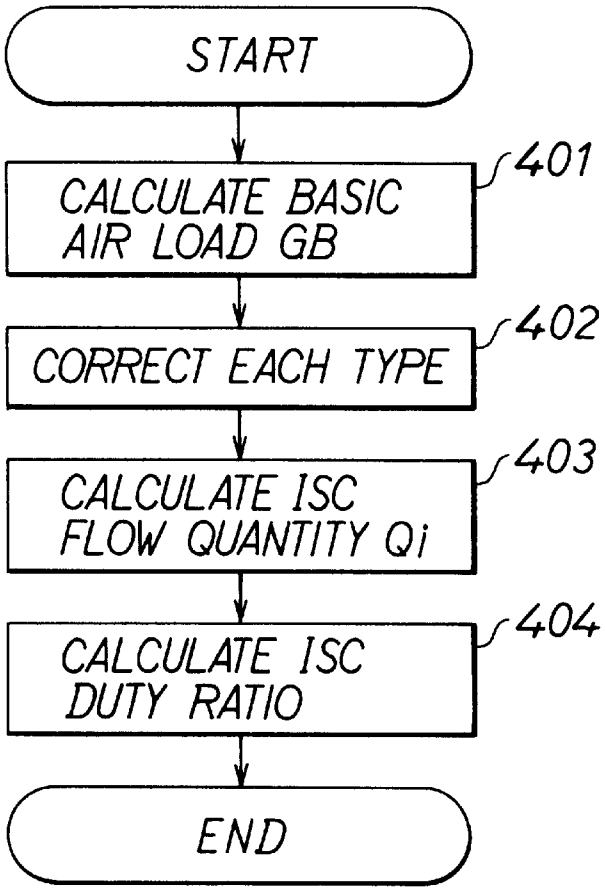
FIG. 5 is a flowchart illustrating a routine for controlling the idle speed according to the embodiment.

Then, a routine for controlling the idle speed is described by referring to the flowchart of FIG. 5. This routine is carried out at intervals of about 16 ms by the ECU 16 to control the operation of the ISC valve 20.

In FIG. 5, the ECU 16 calculates the fundamental amount of air GB that the ISC valve 20 must bear from the temperature THW of the coolant for the engine (Step 401). Then, the ECU 16 performs various fundamental corrections (corrections made depending on the atmospheric pressure, on the temperature of the intake air, and on other factors) on the GB value, thereby calculating the fundamental ISC flow rate QB (Step 402). At this time, the GB value calculated by Step 401 is the mass of air, while the QB value calculated by Step 402 is the volume of air.

Figure 6:
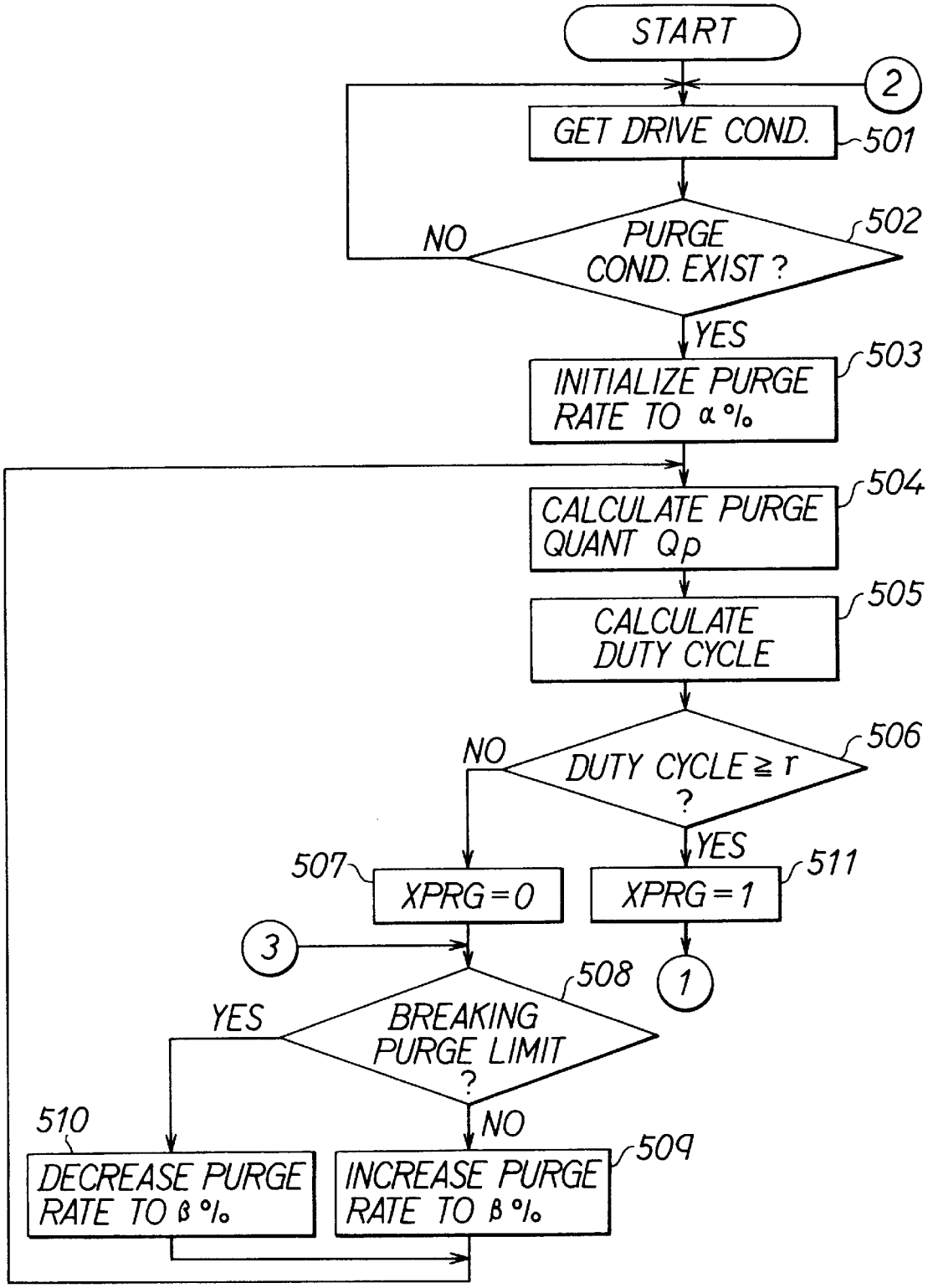
FIG. 6 is a flowchart illustrating a routine for controlling a duty cycle VSV according to the embodiment.
Figure 7:
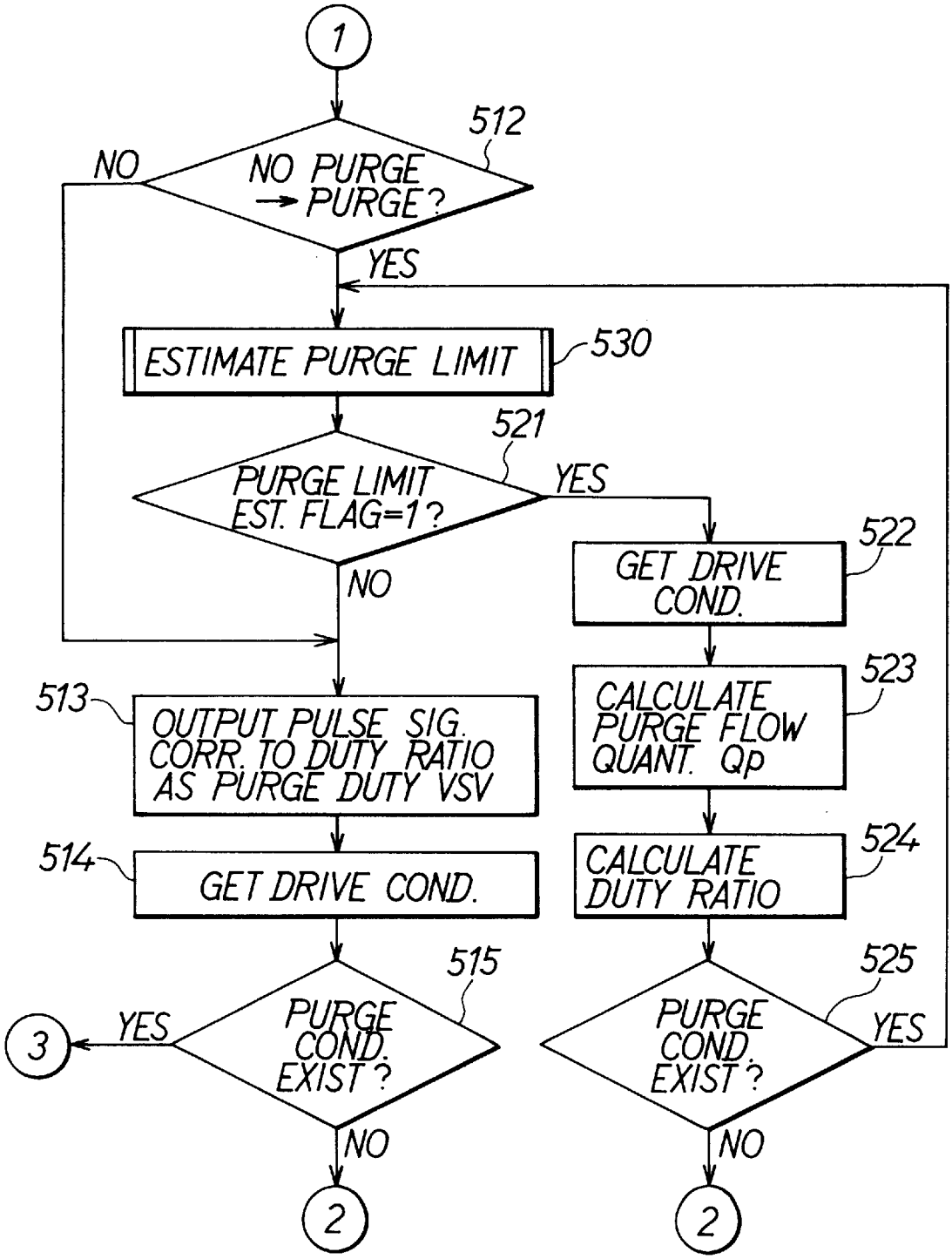
FIG. 7 is a flowchart subsequent to FIG. 6, illustrating the routine for controlling the duty cycle VSV according to the embodiment.

Then, the ECU 16 subtracts the purge flow rate Qp calculated by the routine illustrated in FIGS. 6 and 7 from the fundamental ISC flow rate QB calculated by Step 403, thus calculating ISC flow rate Qi (Qi=QB−Qp).

Figure 11:
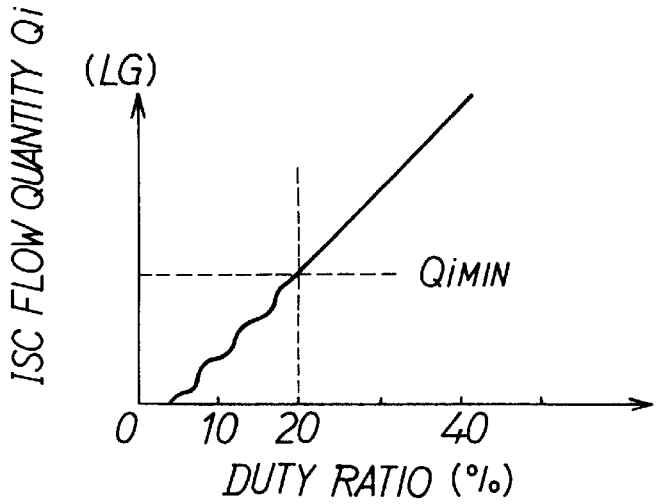
FIG. 11 is a graph illustrating the relation between the ISC flow rate and duty cycle according to the embodiment.

Finally, the ECU 16 calculates the duty cycle at which the ISC valve 20 is activated, the duty cycle corresponding to the amount of air that the ISC valve must bear, using a graph shown in FIG. 11 (Step 404). This map shows the relation between the ISC flow rate Qi (liters/min) and the duty cycle (%). The ECU operates the ISC valve 20 according to the calculated duty cycle. The graph shown in FIG. 11 is empirically determined using the operating frequency of the ISC valve 20 as a parameter.

It can be seen from the map of FIG. 11 that in a region where the duty cycle on the horizontal axis is in excess of about 20%, the relation between the ISC flow rate Qi and the duty cycle is linear and stable. In a region where the duty cycle is less than about 20%, the relation between the ISC flow rate Qi and the duty cycle is not stable. The Qi value at which the relation between the ISC flow rate Qi and the duty cycle becomes unstable is a minimum controllable flow rate Qi, of the ISC valve 20.

[Control of Duty Cycle VSV]

A routine for controlling the duty cycle of the vacuum switching valve (VSV) is next described by referring to FIGS. 6 and 7, the routine forming the gist of the present embodiment. This routine for controlling the duty cycle of the vacuum switching valve is carried out at intervals of 100 ms by the ECU 16. The present routine drives the purge duty cycle vacuum switching valve 14 to execute purge of the evaporated gas.

This control is first outlined. In the present routine, a region where purge of the evaporated gas might hinder the operation of the engine is defined as the purge limit. The purge coefficient PGR is increased or decreased depending on whether the operate condition of the engine has reached the purge limit. Also, the routine forecasts whether there is a possibility that the operating condition after purge will reach the purge limit when the state makes a transition from the non-purging to purging mode.

In particular, in the present embodiment, if the routine judges that the purge limit has been reached during execution of purge, the purge coefficient PGR is reduced to lower the amount of purge. If the result of the decision is that the purge limit is not yet reached, the purge coefficient PGR is increased to increase the amount of purge. In the non-purging mode, the routine forecasts whether there is a possibility of reaching the purge limit. If so, purge is not immediately carried out. The purge is performed after the possibility of arriving at the purge limit is exhausted.

In the present embodiment, points indicated by (a)–(c) have been previously set as purge limit points. Based on them, the routine judges or forecasts that the purge limit is or will be reached.

Figure 10:
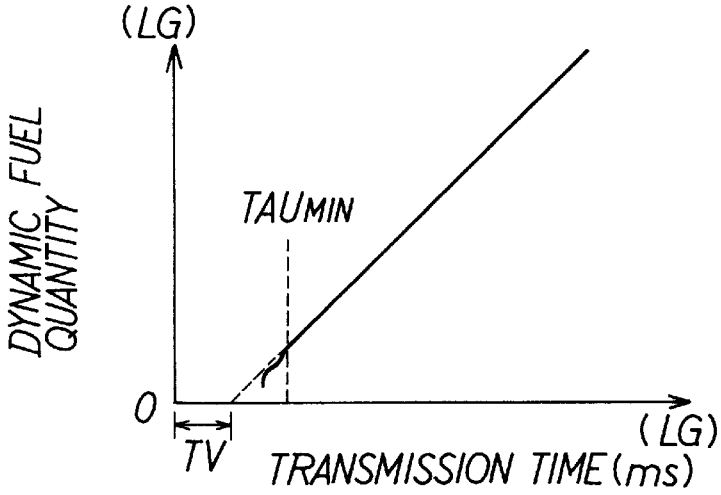
FIG. 10 is a graph illustrating the fuel injection characteristics of an injector according to the embodiment.

(a) A point near the minimum controllable value ($TAU_{MIN}$) of the injection pulse width of the injector 6 is taken as a purge limit point. An allowance A (A=0 is also possible) is added as a safety margin to the minimum energization time $TAU_{MIN}$. If the fuel injection time TAU of the injector 6 is smaller the minimum energization time $TAU_{MIN}$ plus the allowance A, i.e., $TAU<TAU_{MIN}+A$, then the routine judges or forecasts that the purge limit is or will be reached. In this case, the minimum energization time $TAU_{MIN}$ is established based on the fuel injection characteristics of the injector 6 shown in FIG. 10. It can be seen from this figure that linear injection amount characteristics are not obtained at TAU values less than $TAU_{MIN}$. In this figure, Tv indicates the ineffective injection time of the injector 6.

(b) A point close to the minimum controllable value ($Qi_{MIN}$) of the amount of air that the ISC valve 20 must bear is taken as the purge limit point. An allowance B (B=0 is also possible) is added as a safety margin to the minimum controllable flow rate $Qi_{MIN}$. If the ISC flow rate Qi is smaller than this sum, i.e., $Qi<Qi_{MIN}+B$, the routine judges or forecasts that the purge limit is or will be reached. In this case, the minimum controllable flow rate $Qi_{MIN}$ is established based on the ISC characteristic shown in FIG. 11. It can be seen that linear ISC characteristics are not obtained at Qi values less than $Qi_{MIN}$.

(c) A level at which the amount of purge (the amount of inhaled evaporated gas) varies among the cylinders during the distribution of the evaporated gas among the cylinders because the evaporated gas introduced into the internal combustion engine 1 is rich is taken as a purge limit point. More specifically, where the purge correction coefficient FPG is in excess of a given value FK, the result of the decision is that the purge limit point is reached. In this case, the given value FK is empirically preset.

The routine for controlling the duty cycle of the vacuum switching valve (VSV) as illustrated in FIGS. 6 and 7 is described on the basis of the decisions (a)–(c) above.

When the present routine commences, the ECU 16 first reads the operating condition of the engine (Step 501). In particular, the engine speed NE is found from the output signal from the engine speed sensor 18. The intake air pressure PM is found from the intake pressure sensor 3. The engine speed and the intake air pressure are read. Concomitantly, the ECU 16 calculates the amount Qa of introduced air-fuel mixture supplied to the internal combustion engine 1 is calculated from the intake air pressure PM.

Then, the ECU 16 makes a decision as to whether the given purge condition holds (Step 502). This purge condition is based on the operating condition read at Step 501. This condition is valid if the engine speed NE is in excess of a given rotational speed and, at the same time, the amount Qa of the air drawn in is in excess of a certain value. If the purge condition does not hold, the ECU 16 returns to Step 501 and repeats the same processing.

Figure 9:
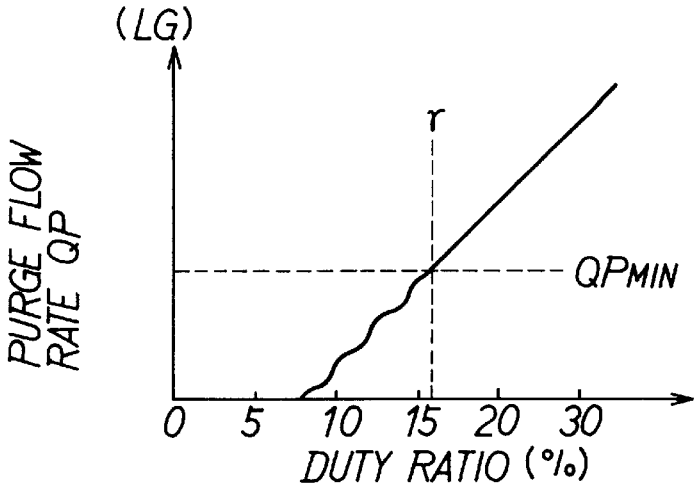
FIG. 9 is a graph illustrating the relation between purged flow rate and duty cycle according to the embodiment.

If the purge condition holds (Step 502), the ECU 16 goes to Step 503, where the ECU sets the initial value of the purge coefficient PGR to $\alpha$% (e.g., 0 or a small value such as on the order of 0.1%) which is so small that it does not affect the operating condition. Then, the ECU 16 calculates the product of the present value of the purge coefficient PGR and the amount Qa of the air drawn in, thus calculating the purge flow rate Qp ($Qp=PGR\cdot Qa$) (Step 504). Subsequently, the ECU 16 calculates the duty cycle (%) at which the purge duty cycle vacuum switching valve 14 operates, according to the map shown in FIG. 9, the duty cycle corresponding to the purge flow rate Qp (liters/min) (Step 505). The graph of FIG. 9 is obtained empirically using parameters that are the pressure difference across the release passage 15 where the purge duty cycle vacuum switching valve 14 is installed and the operating frequency of the switching valve 14. In the graph of FIG. 9, where the duty cycle exceeds a given value γ within about 15–20%, the value y corresponding to $Qp_{MIN}$, the purge flow rate Qp and the duty cycle increase and decrease linearly stably. However, in a region where the duty cycle is less than the given value γ, the relation between the Qp value and the duty cycle is not stable.

Then, the ECU 16 makes a decision as to whether the computed duty cycle is greater or smaller than the given value γ shown in FIG. 9 (Step 506). The result of the decision made at Step 509 is that the duty cycle is less than γ, the ECU 16 judges that there is the possibility that the execution of purge of the evaporated gas adversely affects the behavior of the internal combustion engine 1. The ECU goes to Step 507, where the purge execution-permitting flag XPRG is cleared, i.e., set to 0. For example, at the start-up of the engine, the result of the decision made at Step 506 is NO. In this case, Steps 508–510 (described later) are executed without delivering any pulse signal for operating the purge duty cycle vacuum switching valve 14.

Going to Step 508, the ECU 16 makes a decision as to whether the present state of the execution of purge has reached the purge limit. On the basis of the decisions (a)–(c) above, a decision is made as to whether the purge limit is reached, according to the final injection time TAU, the ISC flow rate Qi, the purge correction coefficient FPG, and other factors obtained at this time. That is, if any one of the Inequalities (5)–(6):

$$TAU < TAU_{MIN} + A \quad (3)$$

$$Qi < Qi_{MIN} + B \quad (4)$$

$$FPG > FK \quad (5)$$

holds, the ECU judges that the purge limit has been reached.

If the result of the decision is that the purge limit is not yet reached, the ECU 16 proceeds to Step 509, where the purge coefficient PGR is increased by a given value β (%). If the result of the decision is that the purge limit has been reached, the ECU 16 goes to Step 510, where the purge coefficient PGR is reduced by a given value β (%). After establishing the purge coefficient PGR in this way, the ECU 16 returns to Step 504, where the above-described processing is repeatedly carried out.

If the result of the decision made at Step 506 is that the duty cycle is greater than γ, then the ECU 16 sets the purge execution-permitting flag XPRG to 1 (Step 511). That is, the purge duty cycle vacuum switching valve 14 is regarded as being capable of operating in its stable region. This is the region of FIG. 9 in which the duty cycle≧γ. The execution of purge is allowed. After setting the flag XPRG, the ECU 16 goes to Step 512 of FIG. 7.

Then, the ECU 16 makes a decision as to whether a transition from the non-purging mode to the purging mode is made (Step 512). Specifically, a decision is made as to whether the purge execution-permitting flag XPRG is just changed from 0 to 1.

If a transition from the non-purging mode to the purging mode is not made, i.e., purge is continued, the ECU 16 makes a decision at Step 512 and goes to Step 513, where a pulse signal corresponding to the calculated duty cycle is delivered to the purge duty cycle vacuum switching valve 14. That is, purge of the evaporated gas is executed.

Then, the ECU 16 reads the operating condition (NE, PM, etc.) of the engine (Step 514) and makes a decision as to whether the purge execution condition holds (Step 515), similarly to Steps 501 and 502. In this case, if the purge condition holds, the ECU 16 goes to Step 508 of FIG. 6, and the purge coefficient PGR is updated at Steps 508–510. That is, if the result of the decision made at Step 506 is YES, and if the result of the decision made at Step 512 is NO, normal purge processing is carried out. If the purge condition does not hold, the ECU goes back to Step 501 of FIG. 6.

If the result of the decision made at the above-described Step 512 is that a transition is made from the non-purging mode to the purging mode, i.e., XPRG is changed from 0 to 1, the ECU 16 proceeds to Step 530, where a purge limit forecasting routine (FIG. 8) (described later) is carried out. The purge duty cycle vacuum switching valve 14 executes purge, and a decision is made as to whether there is the possibility that the purge limit is reached. In the processing of Step 530, the forecast that the purge limit would be reached is made according to various kinds of information, such as the purge correction coefficient FPG, the fuel injection time TAU, the purge flow rate Qp, and the ISC flow rate Qi. The purge limit forecasting flag is set to 1 or 0 according to the result of the forecast. At this time, the purge limit forecasting flag=1 means that there is a possibility that the purge limit will be reached if purge is carried out. The purge limit forecasting flag=0 means that there is no possibility that the purge limit is reached if the purge is executed.

Then, the ECU 16 makes a decision as to whether the purge limit forecasting flag is 1 (Step 521). If the result of the forecast is that the purge limit forecasting flag is 0, i.e., the result of the forecast is that there is no possibility that the purge limit is reached if purge is executed, then the ECU 16 proceeds to 513, where the purge duty cycle vacuum switching valve 14 is activated to carry out purge. Thereafter, Steps 513, 514, 515, and so forth are carried out in this order as mentioned above.

If the result of the decision made at Step 521 is 1, i.e., the purge limit forecasting flag=1 (that is, the forecast that the purge limit would be reached if a purge is carried out), then the ECU 16 goes to Step 522, where the operating condition (NE, PM, etc.) of the engine is read. Then, the ECU 16 computes the purged flow rate Qp (Step 523) and calculates the duty cycle corresponding to the purged flow rate Qp (Step 524), in the same way as the above-described Steps 504 and 505 of FIG. 6. Subsequently, the ECU 16 makes a decision as to whether the purge condition holds (Step 525), in the same manner as Step 502 described above. At this time, if the purge condition holds, the ECU 16 returns to Step 530 and repeatedly performs the above-described processing. If the purge condition does not hold, the ECU goes back to Step 501 of FIG. 6 and repeats the above-described processing.

If the result of the decision made at Step 512 is YES, the ECU is allowed to go to Step 513 only if the forecast that the purge limit will not be reached is made (i.e., purge limit forecasting flag=0). The evaporated gas is purged by the purge duty cycle vacuum switching valve 14.

Figure 8:
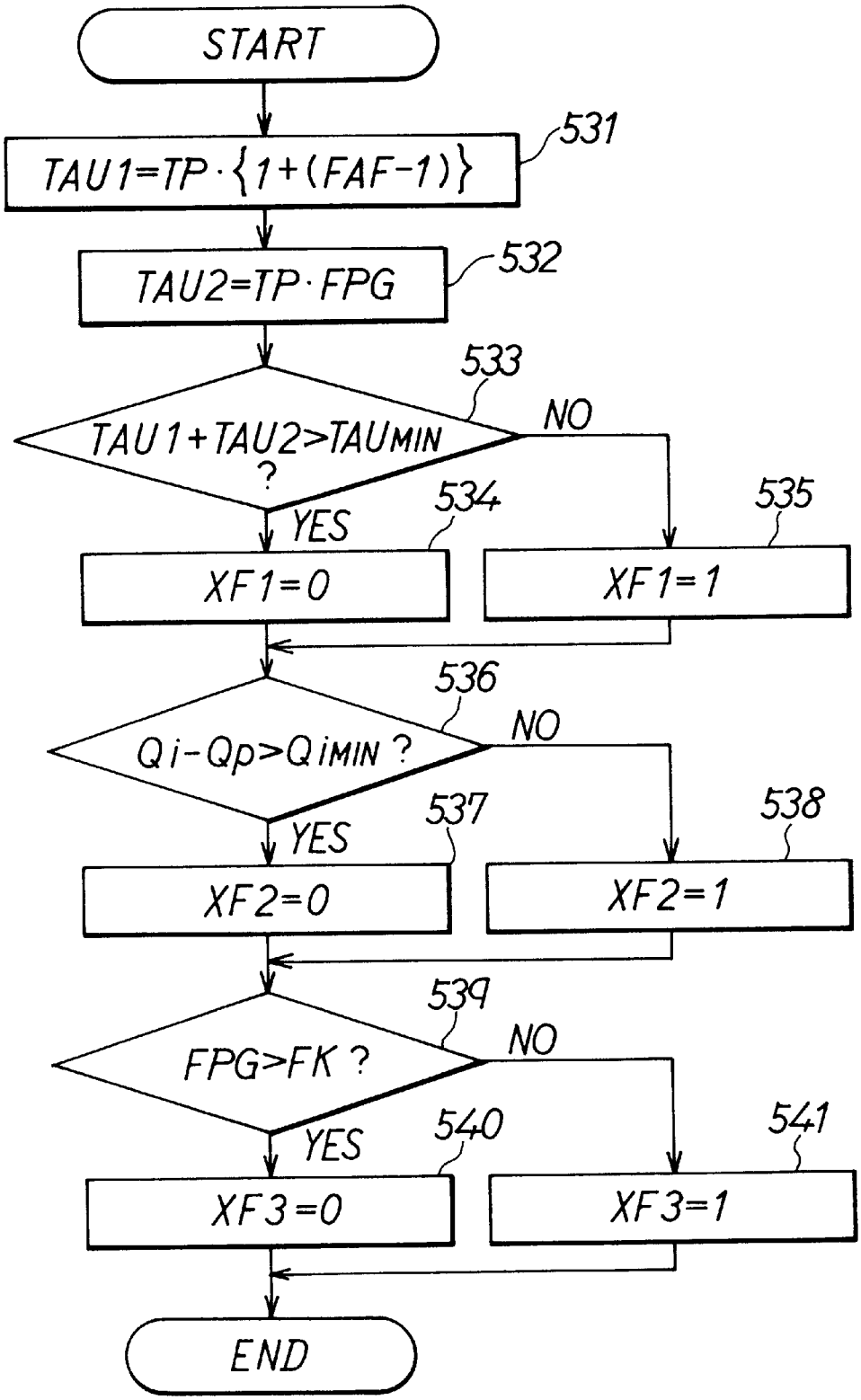
FIG. 8 is a flowchart illustrating a purge limit forecasting routine according to the embodiment.

The purge limit forecasting routine of Step 530 is executed when a transition is made from non-purging to purging mode (i.e., if the result of the decision made at Step 512 of FIG. 6 is YES). This routine is described by referring to the flowchart of FIG. 8. In the present forecasting routine, the forecast of the purge limit is made on the basis of the decisions (a)–(c) above. The routine of FIG. 8 is roughly classified as follows. Steps 531–535 of this figure correspond to processing for forecasting the purge limit based on the fuel injection characteristics of the injector 6. Steps 536–538 correspond to processing for forecasting the purge limit based on the ISC characteristics. Steps 539–541 correspond to processing for forecasting the purge limit based on the purge correction coefficient FPG.

When the routine shown in FIG. 8 starts, the ECU 16 first calculates the fuel injection time TAU1 of the injector 6 in the non-purging mode (Step 531). Assuming that any fuel increase due to purge does not take place (i.e., purge correction coefficient FPG=0), the fuel injection time TAU1 is calculated according to Equation (7):

$$TAU1=TP\cdot\{1+(FAF-1)\} \quad (7)$$

At the next Step 532, the ECU 16 calculates a fuel injection time TAU2 which is assumed to be increased by the execution of purge. This fuel injection time TAU2 is computed from the present concentration of the evaporated gas FGPG and from the purge correction coefficient FPG (=FGPG·PGR) corresponding to the purge coefficient PGR as given by Equation (8):

$$TAU2=TP\cdot FPG \quad (8)$$

Then, the ECU 16 makes a decision as to whether the sum of the fuel injection times TAU1 and TAU2 is greater or smaller than the minimum controllable time (the minimum energization time $TAU_{MIN}$ shown in FIG. 10) of the injector 6 (Step 533). If $TAU1+TAU2>TAU_{MIN}$, the ECU 16 sets a purge limit forecast flag XF1 to 0 (Step 534). If $TAU1+TAU2\leqq TAU_{MIN}$, the ECU 16 sets the flag XF1 to 1 (Step 535).

The ECU 16 makes a decision as to whether the difference between the present value of the ISC flow rate Qi and the purged flow rate Qp is greater or smaller than the minimum value giving a stable linear region of the ISC characteristic (the minimum controllable flow rate $Qi_{MIN}$ in FIG. 11) (Step 536). If $Qi-Qp>Qi_{MIN}$, the ECU 16 sets the purge limit forecasting flag XF2 to 0 (Step 537). If $Qi-Qp\leqq Qi_{MIN}$, the ECU sets the flag XF2 to 1 (Step 538).

The ECU 16 makes a decision as to whether the current value of the purge correction coefficient FPG is greater than the given value FK (Step 539). If FPG>FK, the ECU 16 sets the purge limit forecasting flag XF3 to 0 (Step 540). If FPG≦FK, the ECU sets the flag XF3 to 1 (Step 541).

As described thus far, in the present routine of FIG. 8, the purge limit forecasting flags XF1, XF2, and XF3 are operated according to the three decision conditions of Steps 533, 536, and 539. If all of these flags XF1, XF2, and XF3 are zero, the result of the decision made at Step 521 of FIG. 7 is NO. Purge by the purge duty cycle vacuum switching valve 14 is started. If any one of XF1, XF2, and XF3 is 1, the result of the decision made at this step is YES. The processing for forecasting the purge limit is repeatedly carried out. That is, if purge is not executed, and if the purge limit is forecast, the execution of the purge is inhibited until the conditions giving the purge limit are released, i.e., until all of XF1, XF2, and XF3 are cleared.

In the present embodiment, the processing represented by Steps 508, 509 (510), 512, 513, etc. of FIGS. 6 and 7 corresponds to the purge execution means of the appended claims; Step 530 (FIG. 8) corresponds to the purge limit forecasting means; and the processing represented by Steps 530, 521, 522, etc. (the operation of the flags XF1, XF2, and XF3 and the processing for decisions) corresponds to the purge-inhibiting means of the appended claims.

FIGS. 12A–12E are graphs summarizing the control provided as described above. Purge control of the present embodiment is hereinafter described in further detail by referring to this figure. In FIGS. 12A–12E, time instants t1 and t4 correspond to the transition from the non-purging to purging mode of Step 512 illustrated in FIG. 7. The processing of Step 530 of FIG. 7 (forecast of the purge limit of FIG. 8) is carried out at these time instants t1 and t4. At the time t1, the condition under which the purge limit is reached does not hold. At the time t4, the condition under which the purge limit is reached holds. That is, at the time t1, the purge limit forecasting flag=0. At the time t4, the purge limit forecasting flag=1.

Figures 12A, 12B, 12C, 12D, 12E:
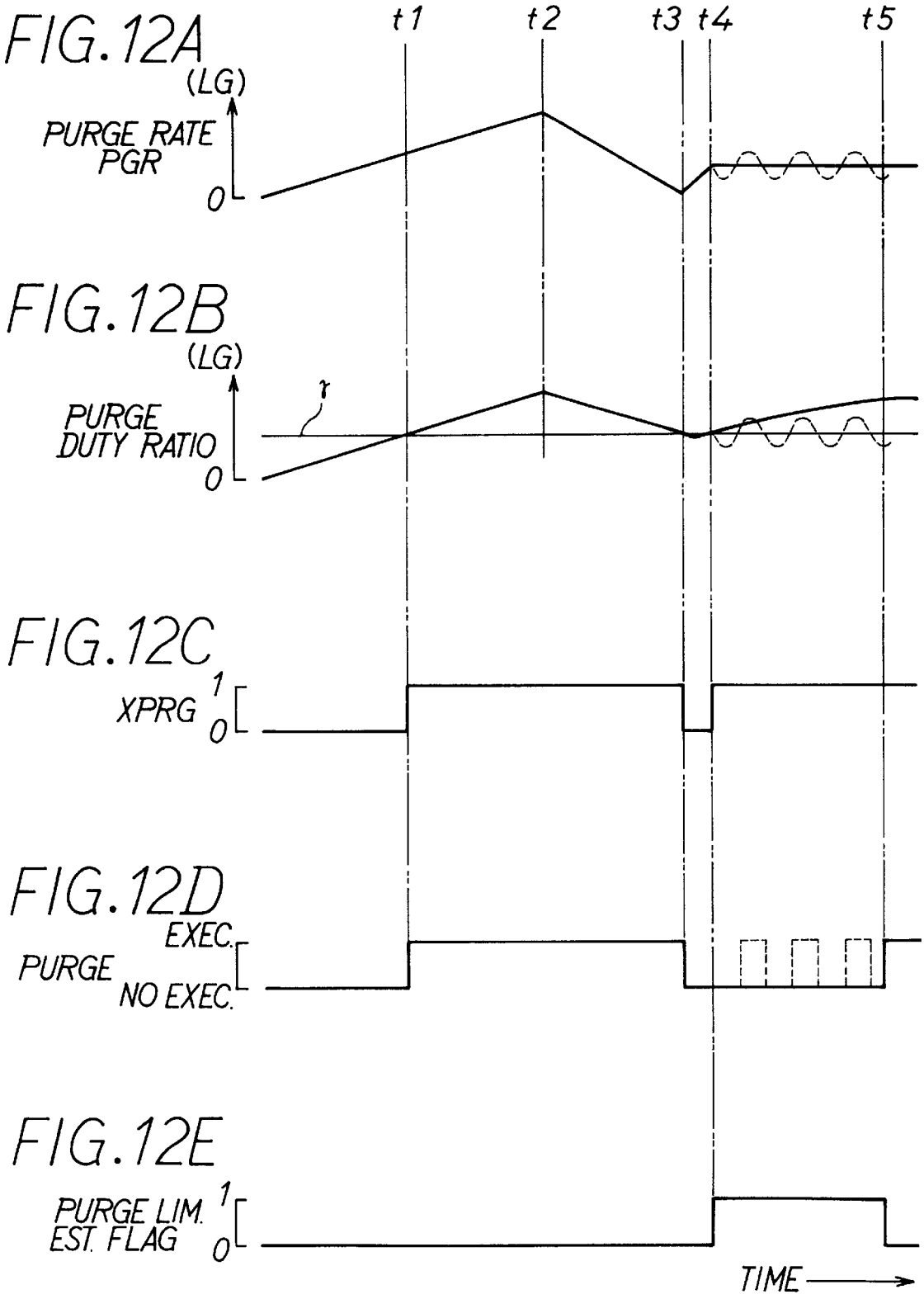
FIGS. 12A–12E are graphs particularly illustrating the operation of the embodiment.

In FIG. 12A, the purge coefficient PGR rises gradually (according to Step 509 of FIG. 6). Concomitantly, the duty cycle exceeds the given value γ at the time t1. The purge execution-permitting flag XPRG is set to 1 in FIG. 12C (Step 511 of FIG. 6), thus allowing the execution of purge. At this time t1, if the purge is carried out, there is no possibility that the purge limit is reached (purge limit forecasting flag=0). Therefore, as XPRG is operated, the purge is carried out by the operation of the purge duty cycle vacuum switching valve 14.

Then, the result of the decision is that the purge limit has been reached at the time t2. The purge coefficient PGR drops gradually in FIG. 12A (Step 510 of FIG. 6). As the purge coefficient PGR decreases, the duty cycle drops below the given value γ at time t3. The purge execution-permitting flag XPRG is cleared in FIG. 12C, i.e., set to 0. The purge owing to the purge duty cycle vacuum switching valve 14 is not carried out.

Subsequently, the purge duty cycle rises again. This duty cycle exceeds the given value γ at time t4, when the purge execution-permitting flag XPRG is set to 1. At this time t4, there arises the possibility that the purge limit will be reached because of the execution of the purge (i.e., the purge limit forecasting flag is set to 1). Therefore, if the purge execution-permitting flag XPRG is kept set, the purge by the purge duty cycle vacuum switching valve 14 is not performed.

At time t5, the result of the decision is that there is no possibility of arrival at the purge limit even if purge is carried out, and the purge limit forecasting flag is cleared, i.e., set to 0. At this time t5, the purge processing owing to the operation of the purge duty cycle vacuum switching valve 14 is resumed.

As described thus far, in the control apparatus of the present embodiment, processing for forecasting the purge limit is carried out. Therefore, under circumstances (during time interval between t4 and t5) where arrival at the purge limit is likely to occur due to execution of purge, the processing for purge is interrupted. The transient operation of the prior art apparatus not performing the processing for forecasting the purge limit is indicated as a comparative example by the solid line. During the time interval between t4 and t5, purge is intermittently carried out. As a result, the air-fuel ratio is disturbed, thus deteriorating the quality of the exhaust gas.

As described in detail thus far, the present embodiment produces the following effects.

(a) In the present embodiment, during non-purging mode, a decision is made as to whether the amount of purged evaporated gas released by the intake system of the engine by the canister 11 reaches the purge limit (instantaneous limit value). If arrival at the purge limit is forecast, the execution of the purge is inhibited. This structure circumvents the problem with the prior art apparatus, i.e., purge is intermittently carried out after the transition from non-purging to purging mode. Consequently, the air-fuel ratio is regulated. Thus, deterioration of the quality of the exhaust gas can be suppressed.

(b) Especially in the structure of the present embodiment, the purge limit is forecast only in the non-purging mode. A decision is made according to the result as to whether the purge should be carried out. Therefore, the purge is not excessively interrupted, e.g., the purge is not forcedly interrupted during the execution of purge. Hence, problems such as a deterioration of the quality of the purge coefficient are not induced.

(c) Furthermore, in the present embodiment, a range of amount of purged evaporated gas hindering the operation of internal combustion engine 1 is forecast as the purge limit. In this range of amount hindering the operation of the engine, the purge is intermittently and repeatedly carried out and consequently disturbs the air-fuel ratio. This range is established in the manner described below.

(i) A region (see FIG. 10) established according to the minimum energization time $TAU_{MIN}$ for which the injector 6 can control the amount of injected fuel.

(ii) A region established according to the minimum controllable air flow rate $Qi_{MIN}$ through the ISC valve 20 (see FIG. 11).

(iii) A region established according to the level at which the amount of purge (the amount of evaporated gas drawn in) can vary among the cylinders during the distribution of the evaporated gas among the cylinders (a region in which FPG>FK).

These are taken as the purge limit.

When the purge limit is established in this way, the purge limit can be preferably and easily forecast. This assures the start of purge in the above-described purge limit regions.

The present invention can be practiced according to the following variations, as well as in the above-described embodiment.

(1) In the above embodiment, the purge duty cycle vacuum switching valve 14 is used to adjust the purge flow rate. Practice of the present invention is not limited to the above-described configuration but rather can be modified to other configurations. In summary, any desired form can be used as long as it is disposed in the release passage 15 and varies the purge coefficient of air containing the evaporated fuel.

(2) In the above embodiment, the output voltage from the oxygen sensor 9 is compared with a given decision level to accomplish air-fuel ratio feedback control. Practice of the present invention is not limited to the above-described configuration but rather may be modified to other configurations. For instance, an air-fuel ratio sensor for linearly detecting the oxygen content of the exhaust gas or an HC sensor for detecting the HC content of the exhaust gas may be used to accomplish the air-fuel ratio feedback control. In summary, any desired form may be adopted as long as it provides feedback control of the air-fuel ratio so that the exhaust gas emitted from the internal combustion engine is suppressed.

(3) In the above embodiment, during the execution of the purge limit forecasting routine of FIG. 8, the processing (Steps 531–535) for forecasting the purge limit according to the fuel injection characteristics of the injector 6, the processing (Steps 536–538) for forecasting the purge limit according to the ISC characteristics, and the processing (Steps 539–541) for forecasting the purge limit according to the purge correction coefficient FPG are separately carried out. In each kind of processing, the purge limit forecasting flag is operated. This may be modified. For example, where the purge limit forecasting flag is set to 1 in any one of the above-described three kinds of processing, the other kinds of processing need not be executed.

The processing for forecasting the purge limit according to the purge correction coefficient FPG is established according to the level at which the amount of purged evaporated gas causes errors during distribution among the cylinders. Instead of the purge correction coefficient FPG, the purged flow rate Qp or the purge coefficient PGR may be used for the decision.

(4) In the above embodiment, the processing for forecasting the purge limit (processing of FIG. 8) is performed when the setting of the purge execution-permitting flag XPRG is changed from 0 to 1. After forecasting the arrival at the purge limit, the same processing is repeatedly carried out until the purge limit forecasting flag is cleared, i.e., set to 0. This configuration may be altered. For example, after forecasting the arrival at the purge limit, the processing of FIG. 8 may be carried out at regular time intervals, and a decision may be made as to whether the arrival at the purge limit is successfully circumvented. In summary, any desired modification may be made as long as it forecasts the purge limit in the non-purging mode.

(5) In the above embodiment, the purge coefficient PGR is increased or reduced according to whether the purge limit has been reached during the processing for calculating the purge coefficient at Steps 508–510 shown in FIG. 6. This may be modified. For example, the deviation ΔFAF (=|FAFAV−1|) of FAFAV values may be taken as a parameter. Where the ΔFAF value is less than the given value (e.g., 5%), the PGR value may be increased. Where the ΔFAF value is in excess of the given value (e.g., 10%), the PGR value may be decreased. In brief, any desired modification may be made as long as the PGR value is established according to the operating condition of the engine.

(7) In the above embodiment, the average value FAFAV of FAF values is calculated by smoothing at Step 105 of the routine illustrated in FIG. 2. Instead, the FAFAV value may be computed by other averaging processing.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An apparatus for controlling the air-fuel ratio of an internal combustion engine having a fuel tank, a canister for storing fuel evaporated from the fuel tank, and a release passage, connected to an intake side of the engine from the canister, for releasing fuel vapor stored in the canister together with air, the apparatus comprising:

a flow control valve, mounted in the release passage, for varying an amount of purged air containing the fuel vapor;

purge-executing means for causing the flow control valve to purge the fuel vapor and air according to an operating condition of the internal combustion engine;

purge limit-forecasting means for forecasting, when purge is not executed, whether the amount of purged fuel vapor and air released to the intake system of the internal combustion engine as a result of the purge by the canister has reached one of an instantaneous purge limit value and a tolerated critical value; and purge-inhibiting means for inhibiting execution of the purge when the purge limit-forecasting means forecasts that the purge limit will be reached.

2. The apparatus of claim 1, wherein the purge limit-forecasting means is for executing a forecast of the purge limit at least during a transient time from a non-purging mode to a purging mode.

3. The apparatus of claim 2, wherein the purge limit-forecasting means is for forecasting as a purge limit an amounts of the purged fuel vapor and air hindering operation of the internal combustion engine.

4. The apparatus of claim 3, wherein the purge limit is set according to a minimum energization time during which an electromagnetic injector can control amount of injected fuel.

5. The apparatus of claim 3, wherein the purge limit is set according to a minimum controllable value at which an idle speed-controlling valve can control amount of air that the valve bears.

6. The apparatus of claim 3, wherein:

the internal combustion engine has a plurality of cylinders;

the fuel vapor and air are released into an intake assembly portion connected to the cylinders; and the purge limit is set according to a level at which the amount of purged fuel vapor and air produce errors the cylinders during distribution amount the cylinders.

7. The apparatus of claim 1, wherein the purge limit-forecasting means is for forecasting as a purge limit a range of amounts of the purged fuel vapor and air hindering operation of the internal combustion engine.

8. The apparatus of claim 7, wherein the purge limit is set according to a minimum energization time during which an electromagnetic injector can control amount of injected fuel.

9. The apparatus of claim 7, wherein the purge limit is set according to a minimum controllable value at which an idle speed-controlling valve can contract amount of air that the valve bears.

10. The apparatus of claim 7, wherein:

the internal combustion engine has a plurality of cylinders;

the fuel vapor and air are released into an intake assembly portion connected to the cylinders; and the purge limit is set according to a level at which the amount of purged fuel vapor and air produce errors among the cylinders during distribution among the cylinders.

11. A method of controlling the air-fuel ratio of an internal combustion engine having a fuel tank, a canister for storing fuel evaporated from the fuel tank, and a release passage, connected to an intake side of the engine from the canister, for releasing fuel vapor stored in the canister together with air, the method comprising:

varying an amount of purged air containing the fuel vapor using a flow control valve, mounted in the release passage;

causing the flow control valve to purge the fuel vapor and air according to an operating condition of the internal combustion engine;

forecasting, when purge is not executed, whether the amount of purged fuel vapor and air released to the intake system of the internal combustion engine as a result of the purge by the canister has reached one of an instantaneous purge limit value and a tolerated critical value; and inhibiting execution of the purge when it is forecast that the purge limit will be reached.

12. The method of claim 11, wherein the forecasting forecasts the purge limit at least during a transient time from a non-purging mode to a purging mode.

13. The method of claim 12, wherein the forecasting forecasts as a purge limit a range of amounts of the purged fuel vapor and air hindering operation of the internal combustion engine.

14. The method of claim 13, further comprising setting the purge limit according to a minimum energization time during which an electromagnetic injector can control amount of injected fuel.

15. The method of claim 13, further comprising setting the purge limit according to a minimum controllable value at which an idle speed-controlling valve can control amount of air that the valve bears.

16. The method of claim 13, wherein:

the internal combustion engine has a plurality of cylinders; and the method includes releasing the fuel vapor and air into an intake assembly portion connected to the cylinders, and setting the purge limit according to a level at which the amount of purged fuel vapor and air produce errors among the cylinders during distribution among the cylinders.

17. The method of claim 11, wherein the forecasting forecasts as a purge limit a range of amounts of the purged fuel vapor and air hindering operation of the internal combustion engine.

18. The method of claim 17, further comprising setting the purge limit according to a minimum energization time during which an electromagnetic injector can control amount of injected fuel.

19. The method of claim 17, further comprising setting the purge limit according to a minimum controllable value at which an idle speed-controlling valve can control amount of air that the valve bears.

20. The apparatus of claim 17, wherein:

the internal combustion engine has a plurality of cylinders; and the method includes releasing the fuel vapor and air into an intake assembly portion connected to the cylinders, and setting the purge limit according-to a level at which the amount of purged fuel vapor and air produce errors among the cylinders during distribution among the cylinders.

21. Apparatus for controlling the air-fuel ratio of an internal combustion engine during its on-going operation after start-up and having a fuel tank, a canister for storing fuel evaporated from the fuel tank, and a release passage connected to an intake side of the engine from the canister for releasing fuel vapor stored in the canister together with air, the apparatus comprising:

a flow control valve mounted in the release passage for varying an amount of purged air containing the fuel vapor;

a valve control circuit connected to cause the flow control valve to purge an amount of fuel vapor and air related to at least one operating condition of the operating internal combustion engine during execution of a purging process;

said valve control circuit including a purge limit forecasting circuit which is operative, during engine operations after engine start-up, when there is no ongoing purging process to inhibit execution of the purging process when the forecast purge limit is reached.

22. A method for controlling the air-fuel ratio of an internal combustion engine, during its ongoing operation after start-up and having a fuel tank, a canister for storing fuel evaporated from the fuel tank, and a release passage connected to an intake side of the engine from the canister for releasing fuel vapor stored in the canister together with air, said method comprising:

placing a flow control valve in the release passage for varying an amount of purged air containing the fuel vapor;

causing the flow control valve to purge an amount of fuel vapor and air related to at least one operating condition of the operating internal combustion engine during execution of a purging process;

forecasting a purge limit, during engine operations after engine start-up, when there is no ongoing purging process and inhibiting execution of the purging process when the forecast purge limit is reached.

* * * * *